US005490407A

United States Patent [19]

Doose

[11] Patent Number: 5,490,407

[45] Date of Patent: Feb. 13, 1996

[54] METHOD OF AND APPARATUS FOR THE SHAPING OF STAINLESS STEEL MEMBRANES FOR VACUUM-HEAT-INSULATION ELEMENTS

[75] Inventor: Ingolf Doose, Stade, Germany

[73] Assignee: Umformtechnik Stade GmbH, Stade, Germany

[21] Appl. No.: 216,102

[22] Filed: Mar. 22, 1994

[30] Foreign Application Priority Data

Mar. 25, 1993 [DE] Germany ..... 43 09 678.6

[51] Int. Cl.[6] ..... B21D 27/10

[52] U.S. Cl. ..... 72/57; 72/465

[58] Field of Search ..... 72/60, 54, 56, 72/57, 58, 465; 29/421.1

[56] References Cited

U.S. PATENT DOCUMENTS 3,564,884 2/1971 Hinshaw ..... 72/57

4,723,430 2/1988 Hahn ..... 72/465

5,201,207 4/1993 Organi et al. ..... 72/465

FOREIGN PATENT DOCUMENTS 0263928 7/1987 European Pat. Off. .

*Primary Examiner*—David Jones

*Attorney, Agent, or Firm*—Herbert Dubno

[57] ABSTRACT

A press for forming an annular membrane of stainless steel strip joined at its ends, utilizes a rubber ram which is compressed by the pressing force between upper and lower plate of the press. The vertical force applied to the rubber ram is converted into a horizontal expansion of the latter to displace the membrane blank into a die having a bellows shape.

12 Claims, 5 Drawing Sheets

METHOD OF AND APPARATUS FOR THE SHAPING OF STAINLESS STEEL MEMBRANES FOR VACUUM-HEAT-INSULATION ELEMENTS

FIELD OF THE INVENTION

My present invention relates to a method of and an apparatus for the shaping of membranes of stainless steel strip for use as heat-transmission barriers in systems which can be evacuated, i.e. for vacuum-thermal-isolation elements. More particularly, the invention relates to a press for this purpose and to a method of operating such a press, intended to impart to the stainless steel membrane a bellows-like shape.

BACKGROUND OF THE INVENTION

In European Patent EP 0 263 928 B1, stainless steel membranes serving as vacuum and heat isolation elements are described. These heat isolation elements are as a rule plate-shaped metallic vacuum shells whose edges may form undesirable hat-transmission bridges between the bottom sheet and the top sheet. To minimize the losses from such thermally conductive bridges, the wall thickness of the envelope is reduced in these regions and the connection between the bottom sheet and the top or cover sheet can be increased by providing between the edges membranes with bellows-like shapes.

To maintain the vacuum along the edges of the sheets, the stainless steel membrane is provided as a stainless steel metal strip whose ends are welded together into a continuous ring.

The formation of a membrane with a bellows like pattern in the form of a ring or endless band of this type, for the aforedescribed purpose, has been found to be problematical since the requisite precision could not be achieved by earlier techniques.

For example, if the strip is shaped in a roll press it is not possible to ensure that the edge regions will be completely flat and homogeneous without defects where the strip is to be connected to the sheets of the heat insulation element.

OBJECTS OF THE INVENTION

It is, therefore, the principal object of the invention to provide an apparatus capable of shaping such stainless steel membranes, i.e. imparting a transverse undulating or bellows-like shape to a stainless steel sheet metal strip, whereby the drawbacks of earlier apparatus used for that purpose are avoided.

Another object of this invention is to provide a method of and an apparatus for the fabrication of shaped stainless steel membranes or strips, welded at ends thereof to form an endless band or ring, if desired, which can effect the shaping simply, at low cost and with the requisite precision for enabling the membrane to be affixed, e.g. welded, to bottom and cover sheets of a heat insulating or vacuum element.

Still another object of this invention is to provide an improved method of and apparatus for the high precision fabrication of bellow-shaped stainless steel membranes so that the edges of the shaped membrane are free from defects which might interfere with the attachment of the membrane between bottom and cover sheets in the fabrication of a structure as described in the aforementioned European patent.

SUMMARY OF THE INVENTION

These objects and others which will become apparent hereinafter are attained, in accordance with this invention inn a press in which the stainless steel sheet metal membrane blank, i.e. the strip is deformed by a rubber ram which transforms a pressing force applied to that ram in one direction into a displacement of the ram surface transversely thereto against the blank which is juxtaposed with that ram.

More particularly, a press for deforming a stainless steel membrane can comprise:

- a base plate dimensioned to absorb pressing force;
- a cover plate disposed above the base plate;
- means for generating a pressing force applied to the cover plate for displacing the cover plate in a pressing force direction toward the base plate;
- a rubber ram juxtaposed with one side of a stainless steel membrane blank between the plates; and
- means between the plates for compressing the ram in the direction with the pressing force whereby the ram presses the blank in a direction transverse to the pressing force direction to deform the membrane blank.

Preferably that press also has a forming die between the plates having a lateral configuration complementary to a shape to be imparted to the stainless steel membrane blank, the blank being juxtaposed with the die along a side of the blank opposite the rubber ram. The means between the plates compressing the ram in the pressing force direction with the pressing force whereby the ram presses the blank against the die in a direction transverse to the pressing force direction can deform the membrane blank into the shape against the die.

The method can comprise the steps of:

(a) with a pressing force, displacing a cover plate toward a base plate dimensioned to absorb the pressing force; and (b) deforming with the pressing force a rubber ram juxtaposed with one side of a stainless steel membrane blank between the plates thereby pressing the blank in a direction transverse to a pressing force direction to deform the membrane blank.

Because of the use of the rubber ram which is elastic, of constant volume and readily deformable laterally under the applied pressure, that ram can be pressed outwardly against a blank which has been welded together as an endless bond over the entire periphery of the band or rim in an extremely uniform manner without the need for complex and mechanically expensive pressing mechanisms. The rubber ram which can be of annular configuration and disposed within the endless blank is comparatively inexpensive to manufacture and can be reused many times. With the altering of the die or substitution of different dies, different shapes can be imparted to respective blanks without the need to change the rubber ring.

According to a feature of the invention, the annular blank or endless band is disposed between the annular elastomeric ram and an annular die having a negative shape of the configuration to be imparted to the blank. The die preferably has a surface juxtaposed with the blank which has the configuration of a bellows and against which the blank is pressed.

The rubber ram can have a central pressing surface juxtaposed with the membrane and from which two inclined flanks extend away from the blank outwardly, opposite the pressing direction. These blanks can have greater dimensions (widths) than the corresponding dimension (width) of the central press surface.

According to another feature of the invention, the die is clamped in the direction of movement of the cover plate between a lower die carrier plate and an upper die cover plate. Between the base plate and the die carrier plate and between the cover plate of the press and the die cover plate, respective rubber springs are provided by means of which the die clamping plates are held in position during a pressing operation.

The base plate and the cover plate have respective plungers which bear upon opposite surfaces of the rubber ram through flat bars which preferably are composed of a constant volume elastic synthetic resin, preferably an intrinsically elastic synthetic resin.

The flat bars can be braced between the die clamping plates on a support block in the horizontal direction and the rubber ram can also be braced inwardly against this block.

It has been found to be advantageous to provide between the rubber ram and the surface of the die a space which is completely filled at the end of the pressing process by the rubber material of the ram and the finished stainless steel membrane.

The blank , as noted, is preferably a stainless steel strip welded into an endless band. That strip can have a thickness of about 0.1 mm, especially about 0.15 mm.

During the process of the invention, the central portion of the blank is preferably passed into the blank while outer portions of the die deflect over the bevelled blanks. With further compression of the rubber ram, these outer portions are in turn bent over the die to complete the shaping process.

BRIEF DESCRIPTION OF THE DRAWING

The above and other objects, features, and advantages will become more readily apparent from the following description, reference being made to the accompanying drawing in which:

FIGS. 4–7 are cross sectional views through the press at the region of the shaping portion of the die, illustrating successive stages in the operation of the pressing.

SPECIFIC DESCRIPTION

The apparatus for shaping the stainless steel membrane according to the invention basically comprises a press which has a base plate 1 adopted to take up the pressing force generated by the press ram 2, i.e. a hydraulic ram which can be of conventional design and produce a pressing force downwardly, i.e. in the vertical direction.

Figure 1:
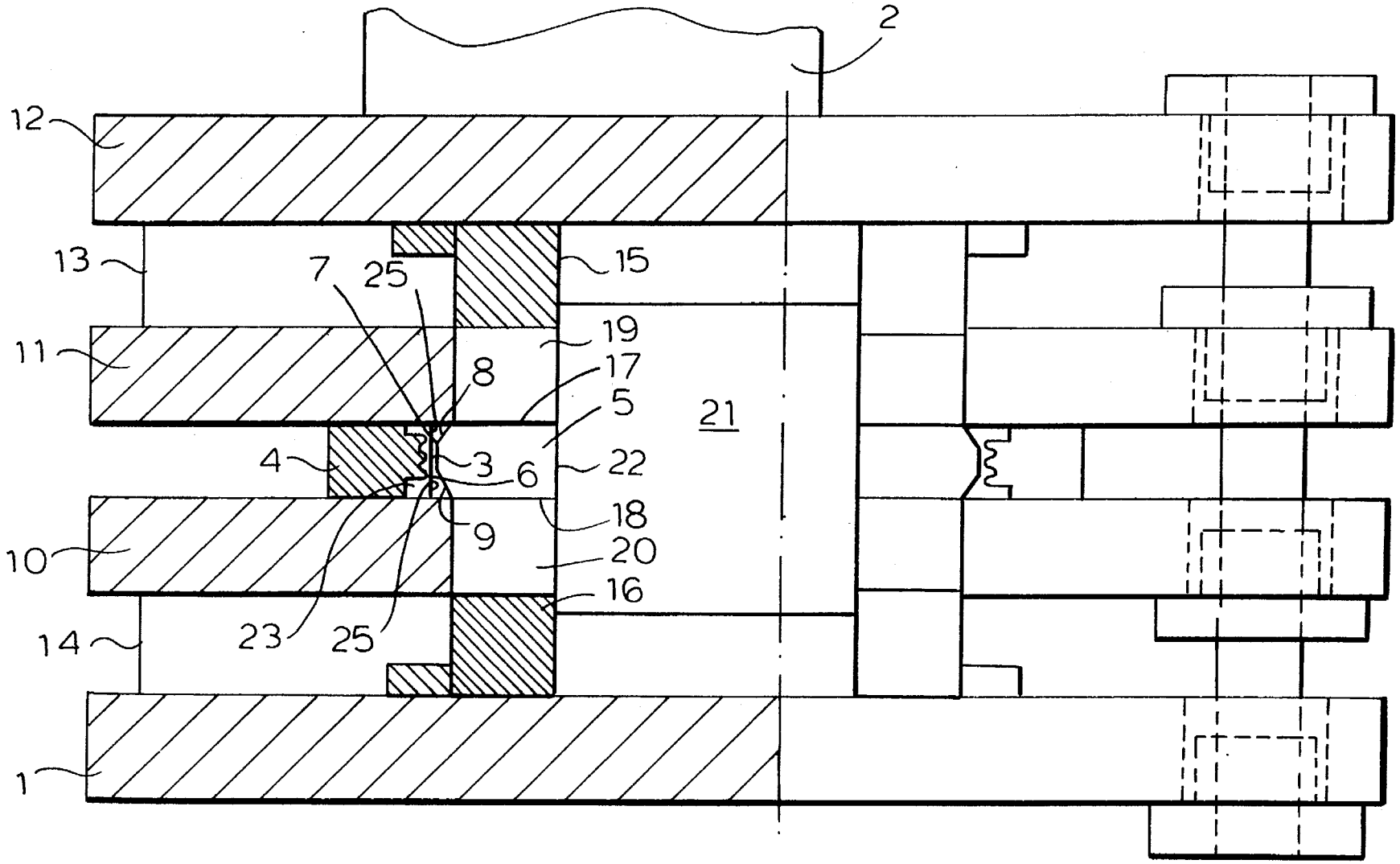
FIG. 1 is a side elevational view of a press in accordance with the invention, partly broken away at the left side.
Figure 2:
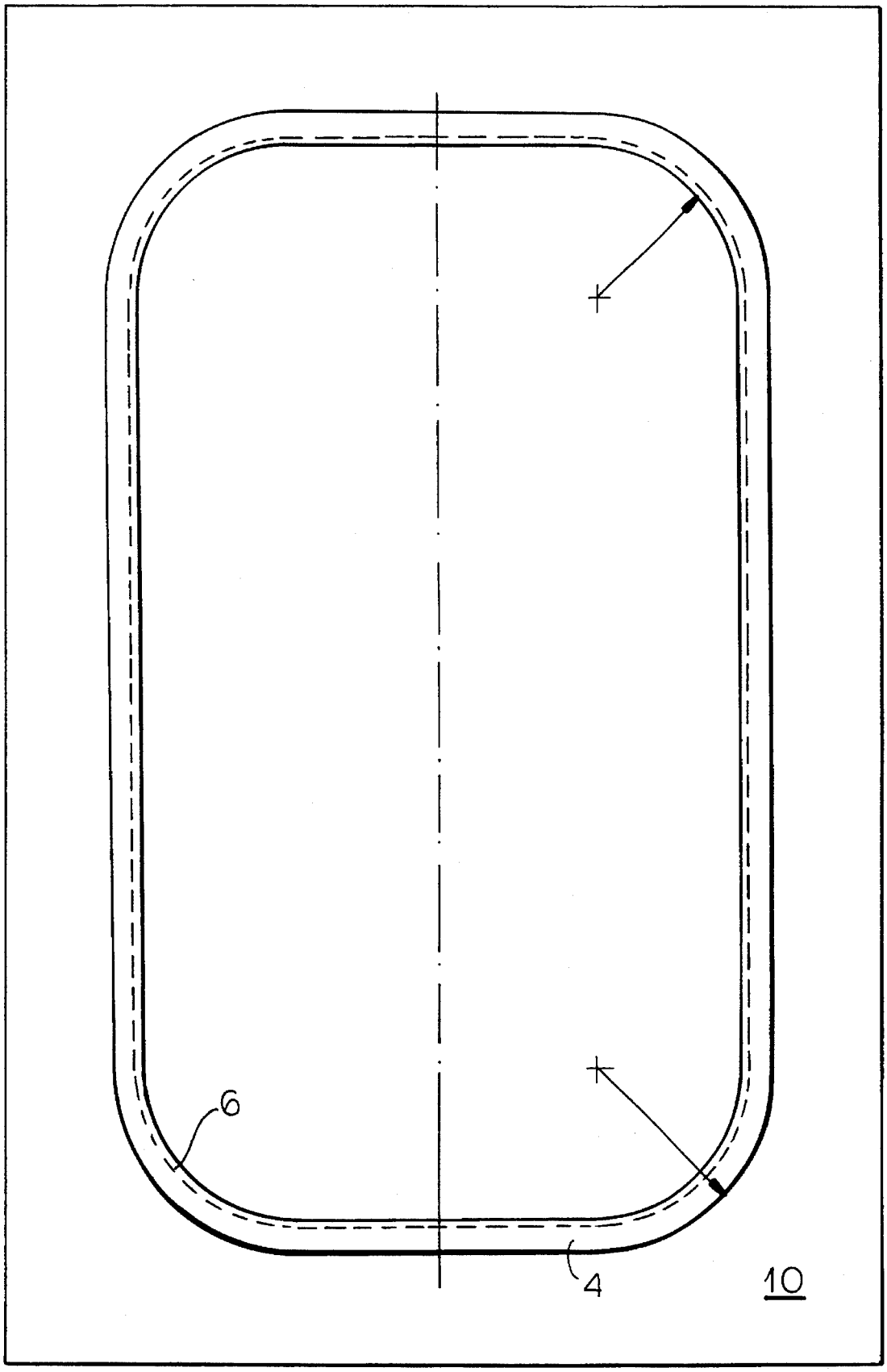
FIG. 2 is a plan view of a die as seen from above a lower clamping plate, the portions of the press above the latter having been removed.

This pressing force is applied to a cover plate 12 which can transit the pressing force. The pressing force is transmitted to a rubber ram 5 which can be annular and lies immediately inwardly of a stainless steel endless band 3 forming the blank to be shaped and which lies inwardly of an annular die 4 (see FIGS. 1 and 2) so that the blank is disposed between the rubber ram 5 and the die 4.

The die 4 is formed at its surface 6 juxtaposed with the blank 3 with a bellows pattern against which the blank is to be pressed to shape the blank.

A central portion 7 of the rubber ram 5 forms an initial pressing surface and is juxtapose with the blank at the center if the die. From this central pressing surface 7, two flanks 8 and 9 extend outwardly and rearwardly as bevels inclined to the pressing direction.

These flanks 8 and 9 have greater widths than the width of the central surface 7 of the ram 5.

The die 4 is clamped in the direction of movement of the press ram 2 between a lower die carrying plate 10 and an upper die covering plate 11, the plates 10 and 11 forming die clamping plates.

Between the base plate 1 and the clamping plate 10 and between the clamping plate 11 and the cover plate 12 upon which the ram 2 bears, extend respective rubber springs 13, 14 which hold the clamping plates 10 and 11 against the die 4 and retain the die 4 in place during the pressing process when the cover plate 12 is displaced toward the base plate 1.

The base plate 1 and the cover plate 12 each have respective opposing plungers 15, 16 which bear against pressing force transmitting flat bars 19 and 20 bearing, in turn, against the opposite surfaces 17 and 18 of the rubber ram 5. These bars 19 and 20 can be composed of a constant volume elastic synthetic resin which can be fabricated from an intrinsically elastic synthetic resin material.

The bars 19 and 20 are braced in the horizontal direction against edges of the clamping plates 10 and 11 and against a support or bracing block 21. The rubber ram 5 is backed at its rear surface 22 turned away from the blank 3, by this block.

Figure 3:
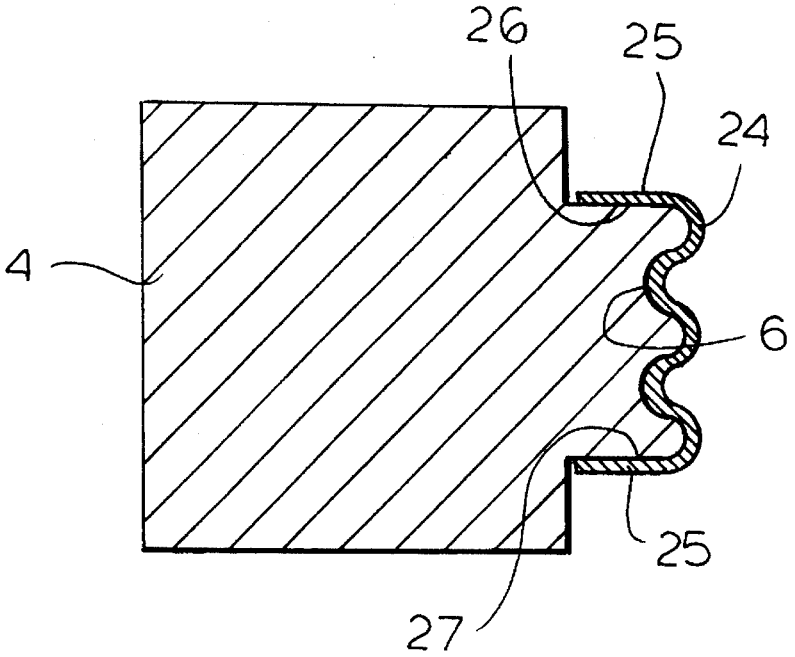
FIG. 3 is a cross sectional view through the die showing the finished membrane thereon.

Between the ram 5 in the region of the central pressing surface 7 and the flanks 8 and 9, and the surface 6 of the die 4 a hollow or space 23 is provided which, at the end of the pressing process is completely filled by the material of the ram 5 and the stainless steel membrane 24 (FIG. 3).

The blank 3 is comprised of a stainless steel strip welded together at its ends and of a thickness of the order of 0.1 mm, say 0.15 mm. This thickness of the blank has been found to yield an especially stable deformed membrane and to be precisely deformable with the rubber ram 5.

In operation, after the blank 3 has been inserted in the space 23 and the remainder of the apparatus assembled, the press ram 2 drives the cover plate downwardly, i.e. moves the cover plate 12 toward the base plate 1. The plungers 15 and 16 are moved toward one another and the rubber springs 13 and 14 pressed together so that the die clamping plates 10 and 11 fix the die 4.

Figure 3A:
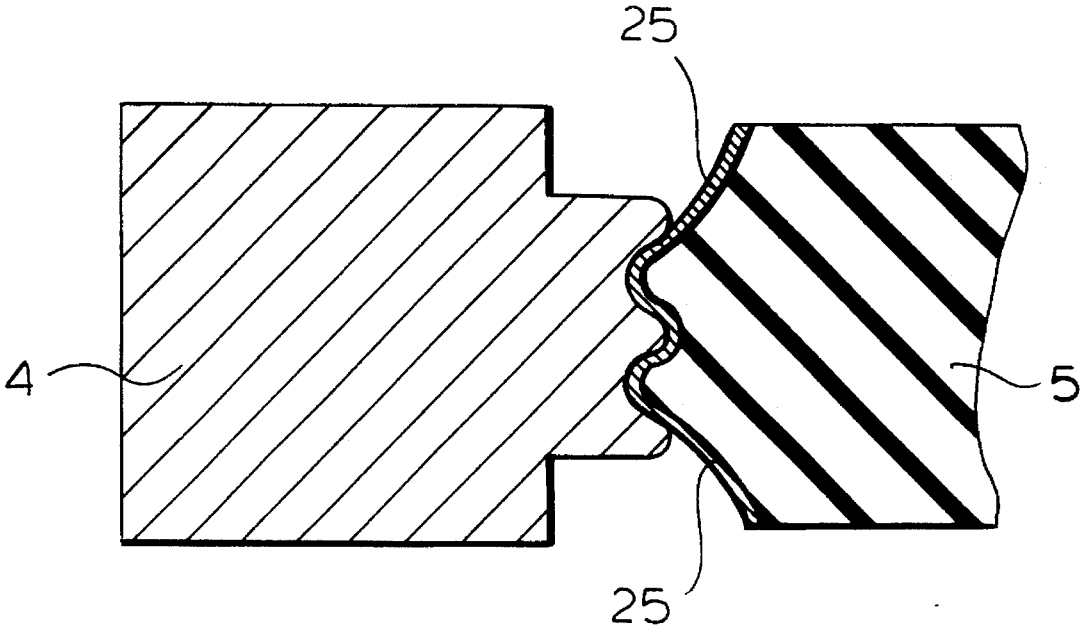
FIG. 3A is a cross sectional view showing an intermediate stage in the shaping of the membrane.
Figure 4:
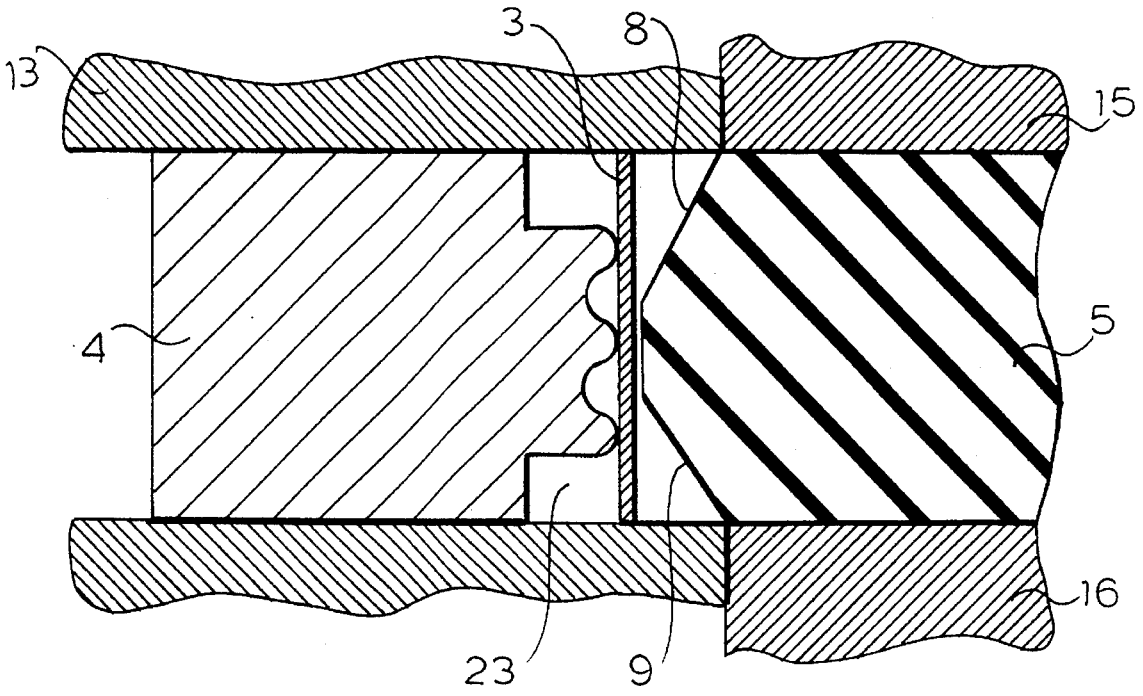
Figure 5:
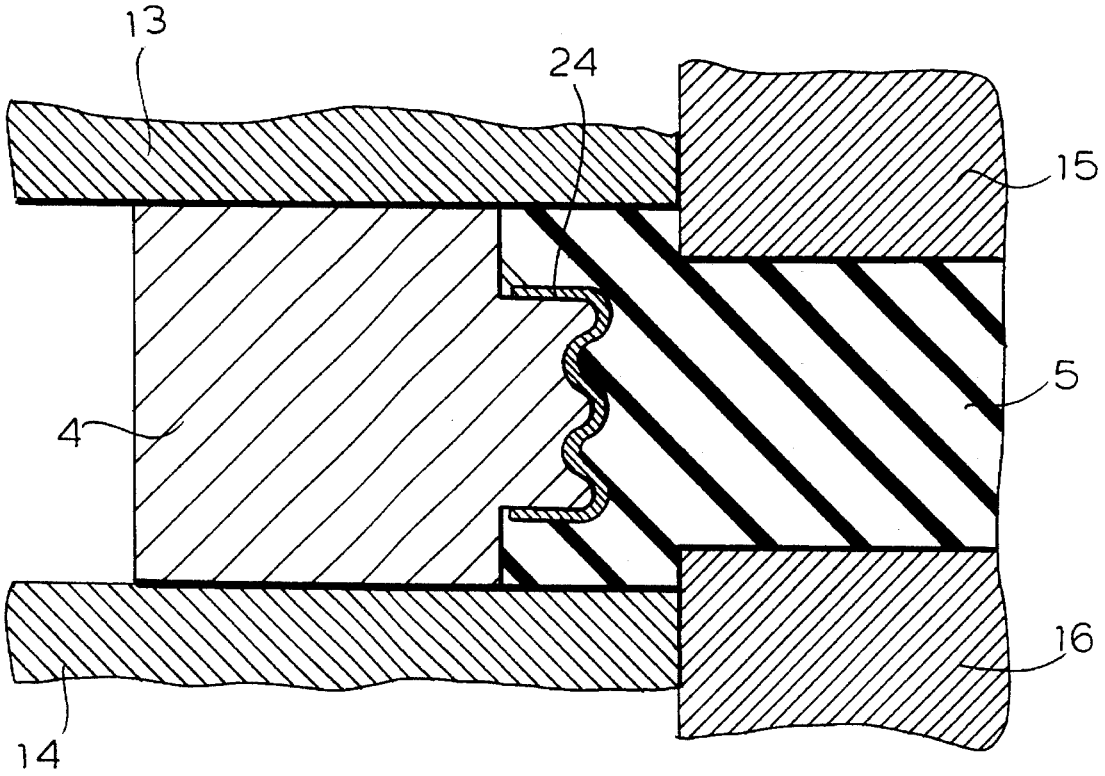
Figure 4:
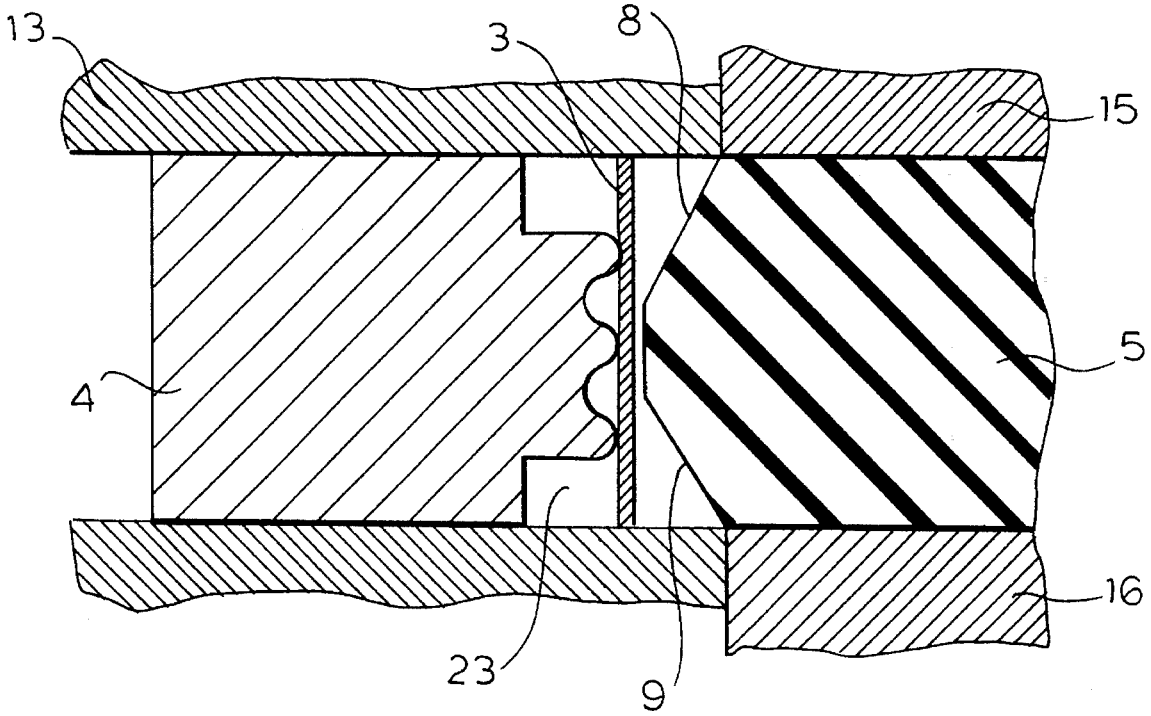

Via the bars 19 and 20 the pressing force is applied to the ram 5. Since the ram 5 is backed at 22 by the block 21, the rubber material of the ram 5 cannot extrude in this direction. The central pressing surface 7 presses the blank 3 progressively into the bellows shaped surface 6 of the die 4 (compare FIG. 4, showing the stage just before pressing begins and FIG. 3A showing the initial pressing operation). The outer portions 25 of the blank are bent back over the flanks 8 and 9 (FIG. 3A) with further compression of the ram 5, the rubber of the ram 25 extrudes fully into the hollow space (FIG. 5) to complete the formation of the membrane.

The strips 25 are then pressed onto the lateral surfaces 26 and 27 of the die.

Figure 6:
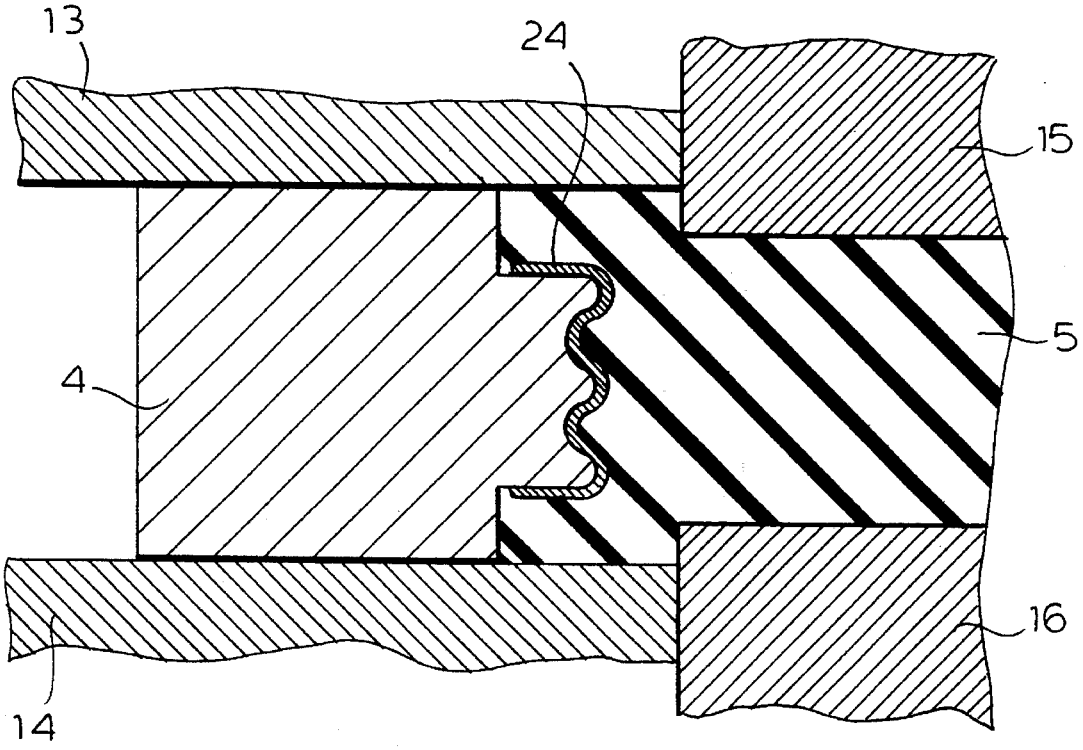

Upon retraction of the plungers 15 and 16, the ram 5 is restored to its original condition (FIG. 6), The space 23 is again free and the press can be opened and the membrane 24 removed. (FIG. 7).

In FIGS. 4–7, the plungers 15 and 16 have been shown to be moved symmetrically toward one another for better understanding as to how the rubber ram operates to convert the vertical pressing force into a horizontal displacement. In practice, however, the plungers 16 may be stationary with only the plungers 15 effecting extrusion of the rubber ram via the member 19 if desired.

I claim:

1. A press for deforming a stainless steel membrane, comprising:

a base plate dimensioned to absorb pressing force;

a cover plate disposed above said base plate;

means for generating a pressing force applied to said cover plate for displacing said cover plate in a pressing force direction toward said base plate;

a rubber ram juxtaposed with one side of a stainless steel membrane blank between said plates;

means between said plates for compressing said ram in said direction with said pressing force whereby said ram presses said blank in a direction transverse to said pressing force direction to deform said membrane blank;

a forming die between said plates having a lateral configuration complementary to a shape to be imparted to the stainless steel membrane blank, said blank being juxtaposed with said die along a side of said blank opposite said rubber ram;

said means between said plates compressing said ram in said pressing force direction with said pressing force whereby said ram presses said blank against said die in a direction transverse to said pressing force direction to deform said membrane blank into said shape against said die; and upper and lower die clamping plates between said cover and base plate and clamping said die between the clamping plates upon movement of said cover plate in the pressing force direction.

2. The press defined in claim 1 wherein said die has a surface juxtaposed with said blank and against which said blank is pressed by said rubber ram, said ram being of a bellows shape.

3. The press defined in claim 1 wherein said rubber ram has a central surface confronting said blank and a pair of flanks beveled outwardly away from said central surface in a direction opposite a direction in which said ram is pressed against said blank.

4. The press defined in claim 3 wherein said flanks have greater width dimensions than said central surface.

5. The press defined in claim 1, further comprising rubber spring bodies between said cover plate and said upper die clamping plate and between said base plate and said lower die clamping plate for retaining said cover plates in position during a press operation.

6. The press defined in claim 5 wherein said means between said plates for compressing said ram includes:

respective force-transmitting bars bearing in said pressing force direction on opposite sides of said rubber ram; and respective plungers between said cover plate and an upper one of said bars and between said base plate and a lower one of said bars.

7. The press defined in claim 6 wherein said bars are composed of a constant-volume intrinsically elastic synthetic resin.

8. The press defined in claim 6, further comprising a bracing block between said cover and base plates, said upper bar being horizontally braced between an upper one of said dieclamping plates and said block, said lower bar being horizontally braced between a lower one of said die-clamping plates and said block.

9. The press defined in claim 8 wherein said rubber ram at a side turned away from said membrane blank is braced against said block.

10. The press defined in claim 1 wherein a space is provided between said surface of said die and the rubber ram which is substantially filled with material of said ram at an end of a pressing process.

11. The press defined in claim 1 wherein said blank is a strip of sheet metal having ends welded together into an endless blank.

12. The press defined in claim 11 wherein said strip has a thickness of about 0.10 mm.

* * * * *